US005279457A

United States Patent [19]

Masunaga

[11] Patent Number: 5,279,457

[45] Date of Patent: Jan. 18, 1994

[54] EXTERIOR WATCH BOX

[75] Inventor: Shinichi Masunaga, Tokyo, Japan

[73] Assignee: Seiko Epson Corporation, Tokyo, Japan

[21] Appl. No.: 999,588

[22] Filed: Dec. 30, 1992

Related U.S. Application Data

[63] Continuation of Ser. No. 701,712, May 17, 1991, abandoned.

[51] Int. Cl.[5] ..... B65D 5/50

[52] U.S. Cl. ..... 229/199; 206/477; 220/652

[58] Field of Search ..... 229/199; 220/416, 651, 220/652; 206/45.14, 477, 485

[56] References Cited

U.S. PATENT DOCUMENTS

| | | | |
|---|---|---|---|
| 2,483,174 | 9/1949 | Belsinger | 220/441 |
| 2,582,715 | 11/1950 | Wagner | 220/441 |
| 2,597,847 | 5/1952 | Reeser | 220/441 |
| 2,671,598 | 3/1954 | Rosen | 220/441 |
| 2,692,747 | 10/1954 | Strauss | 220/416 |
| 2,819,008 | 1/1958 | White et al. | 220/441 |
| 2,893,617 | 7/1959 | George | 220/441 |
| 2,980,241 | 4/1961 | Howell, Jr. et al. | 206/45.19 |
| 3,157,346 | 11/1964 | Hamilton | 229/23 AB |
| 3,159,273 | 12/1964 | Schecterson et al. | 206/45.19 |
| 3,861,579 | 1/1975 | Manis et al. | 220/416 |
| 3,892,675 | 7/1975 | Roeshman | 220/416 |
| 3,955,675 | 5/1976 | Kurtz | 220/416 |
| 4,026,411 | 5/1977 | Johnson | 206/45.19 |
| 4,341,308 | 7/1982 | Pasguini | 206/45.14 |
| 4,753,341 | 6/1988 | McIntyre | 206/45.19 |

FOREIGN PATENT DOCUMENTS

| | | | |
|---|---|---|---|
| 1575372 | 9/1980 | United Kingdom | 229/23 AB |

*Primary Examiner*—Allan N. Shoap
*Assistant Examiner*—Christopher McDonald
*Attorney, Agent, or Firm*—Blum Kaplan

[57] ABSTRACT

An exterior watch carton having a removable support insert is provided. The walls of the support insert align with the walls of the carton to form a reinforced carton. The support insert interlocks with the base of the carton so that the support insert may be removed. The support insert also changes the interior dimensions of the carton while not interfering with the external dimensions.

7 Claims, 3 Drawing Sheets

EXTERIOR WATCH BOX

This is a continuation of application Ser. No. 07/701,712, filed May 17, 1991, now abandoned.

BACKGROUND OF THE INVENTION

The present invention relates to an exterior watch carton and in particular, to an exterior watch carton which is lined with a support insert to reinforce the sidewalls of the carton and to change the internal area of the carton without affecting the outer dimensions.

Generally, conventional exterior watch cartons include a base, a plurality of sidewalls, a front wall, a rear wall and a lid. These components cooperate with one another to form a three-dimensional carton capable of holding an interior watch box.

In most instances, the cartons are produced with uniform dimensions for display purposes and ease of handling. Therefore, the carton must be constructed to accommodate interior watches boxes of all sizes. Since the carton must accommodate large watch boxes, smaller watch boxes do not fit securely in the exterior carton.

Another problem exists in that the cardboard construction of the carton may not be strong enough for all uses. Since the cartons are produced having a uniform thickness, it is difficult to provide a reinforced carton.

Accordingly, it is desired to provide an improved watch carton with reinforced sidewalls and a mechanism for changing the interior area of the carton without disrupting the uniformity of the exterior.

SUMMARY OF THE INVENTION

Generally speaking, in accordance with the invention, an exterior watch carton for retaining an interior watch box includes a support insert for reinforcing and strengthening the sidewalls of the carton.

In addition, the support insert decreases the area of the carton without sacrificing the uniformity of the exterior. Therefore, it is possible to place different size watch boxes in cartons having the same exterior dimensions because a support insert with the appropriate dimensions will secure the interior watch box, regardless of size, inside the carton.

The support insert has sidewalls that correspond and align with the sidewalls of the carton. In addition, the carton includes two tabs that interlock with corresponding symmetrical cutouts on the support insert to keep the support insert in place.

The support insert is easily removable so that support inserts of varying widths can be inserted depending on the contents of the carton.

Accordingly, it is an object of the invention to provide an improved exterior watch carton having reinforced sidewalls.

It is another object of the invention to provide an improved exterior watch carton having a variable interior while maintaining exterior uniformity.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is an alternative sectional view of the carton taken along line 4—4 of FIG. 3; and

DETAILED DESCRIPTION OF THE PREFERRED EMBODIMENTS

Figure 1:
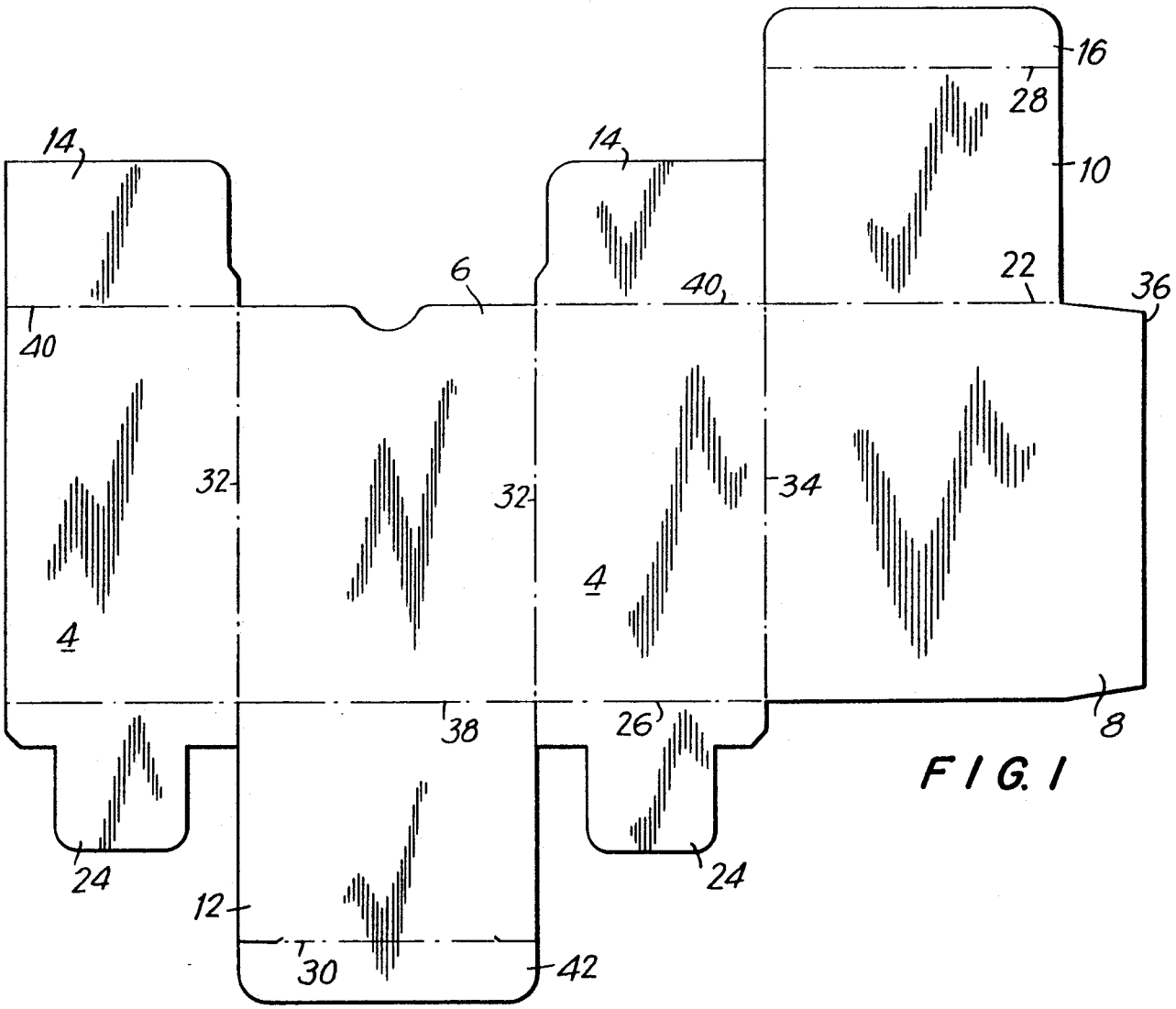
FIG. 1 is a plan view of an unfolded carton in accordance with the present invention.

Referring specifically to FIG. 1, an unfolded exterior watch carton in accordance with the present invention is depicted. An unassembled watch carton 100 includes a base 12, sidewalls 4, a front wall 6 and a rear wall 8. Front wall 6 is hingedly connected to two of sidewalls 4 at front wall hinge lines 32. Rear wall 8 is hingedly connected to one of sidewalls 4 at rear wall hinge line 34.

Also included are a lid 10 hingedly connected to rear wall 8 at lid hinge line 22 and a front lid flap 16 hingedly connected to lid 10 at flap hinge line 28.

Side walls 4 are hingedly attached to support tabs 24 which fold over tab hinge lines 26. In addition, two lid tabs 14 are hingedly attached to sidewalls 4 at lid tab hinge lines 40.

Base 12 is hingedly connected to front wall 6 at base hinge line 38. A base flap 42 is hingedly connected to base 12 at base flap hinge line 30.

Figure 3:
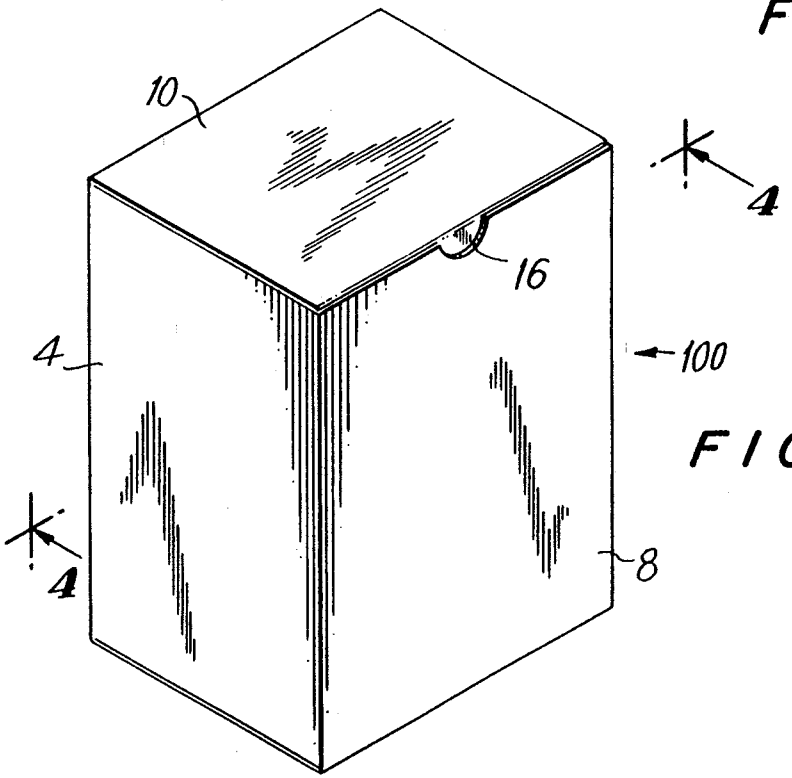
FIG. 3 is a perspective view of the assembled carton of FIG. 1 with folded support insert.

In order to form assembled carton 100, as illustrated in FIG. 3, rear wall 8 folds over hinge line 34 and sidewalls 4 fold over front wall hinge lines 32 to form carton 100. Rear wall edge 36 is fixed (e.g. glued) to one of sidewalls 4 to maintain the shape of assembled carton 100. Base 12 is folded over base hinge line 38. In addition, lid tabs 14 are folded over lid tab hinges 40. Thereafter, lid 10 is folded over lid hinge line 22 to facilitate the closing of assembled carton 100.

Figure 2:
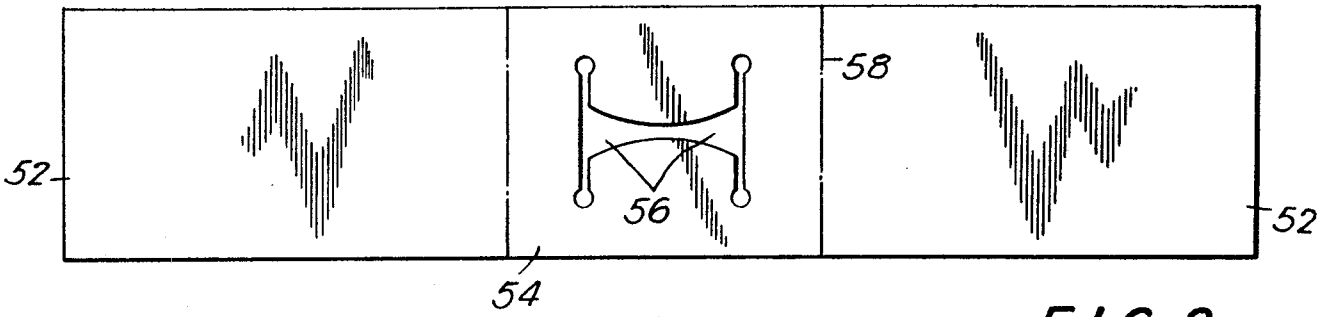
FIG. 2 is a plan view of an unfolded support insert in accordance with the present invention.

Referring specifically to FIG. 2, a support insert 50 is adapted for insertion in carton 100. Unassembled support insert 50 includes a support base 54 and a similar pair of sidewall supports 52. Support base 54 includes a pair of tab cut-outs 56 therein. Support base 54 is hingedly attached to sidewall supports 52 at support hinge lines 58. Sidewall supports 52 are folded toward support base 54 so that they are orthogonal to support base 54.

Figure 4:
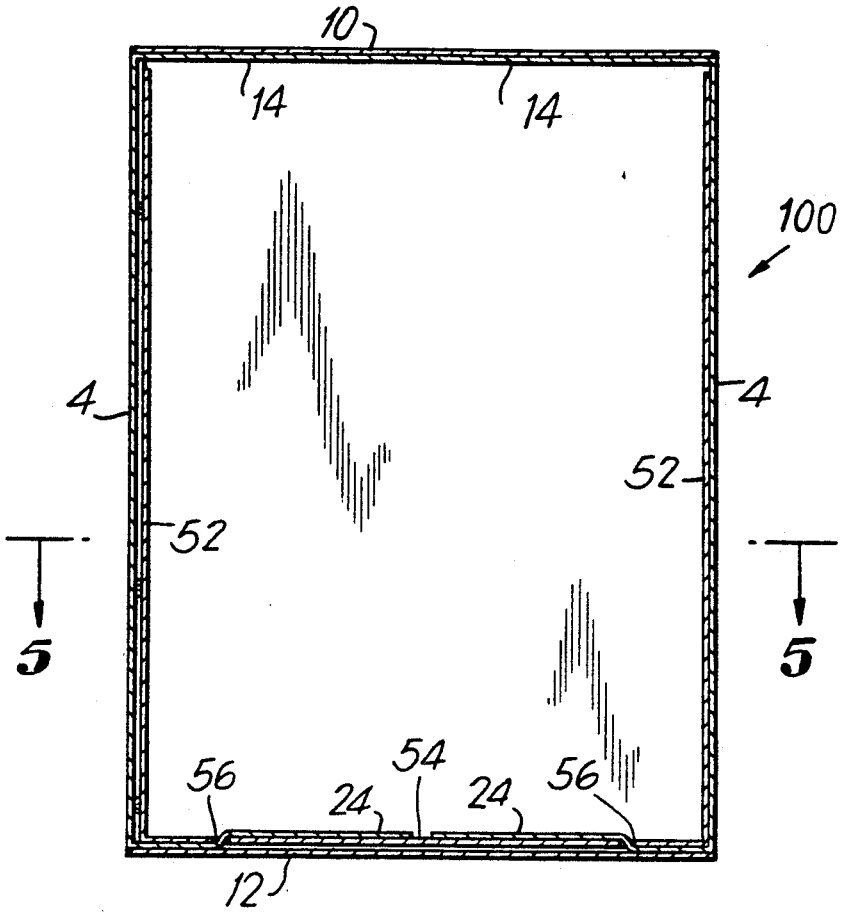
FIG. 4 is a sectional view of the carton taken along line 4—4 of FIG. 3.
Figure 5:
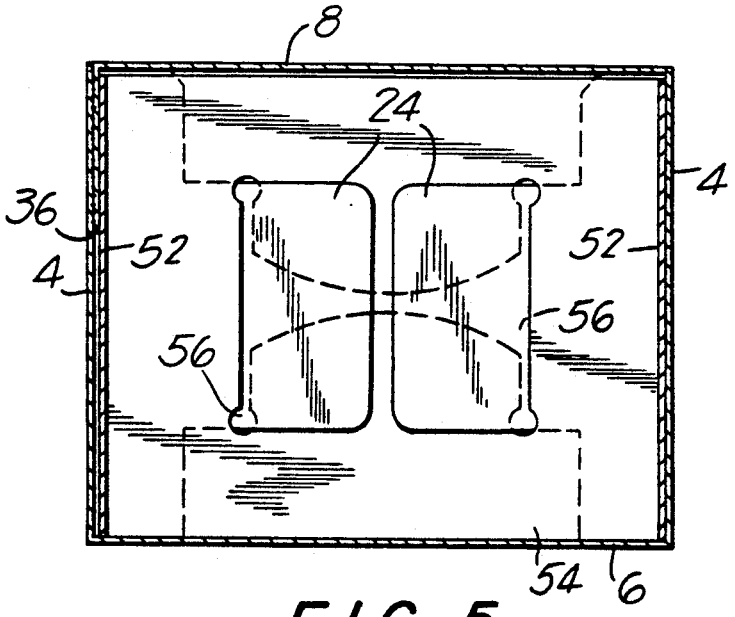
FIG. 5 is a sectional view of the carton taken along line 5—5 of FIG. 4.

The assembled carton with interior support insert therein are depicted in FIGS. 4 and 5. Support insert 50 is inserted into carton 100 before base 12 is folded over hinge line 38. Support base 54 corresponds to and aligns with base 12 and sidewall supports 52 correspond to and align with each of sidewalls 4. Support base 54 is secured in position in carton 100 by the cooperation of support tabs 24 and tab cut-outs 56 in support base 54. Support tabs 2 interlock with tab cut-outs 56 to secure support insert 50 in position inside carton 100. Support base 54 can be removed from carton 100 by removing support tabs 24 from tab cut-outs 56.

Referring specifically to FIG. 6, an embodiment of exterior watch carton 100 is disclosed having a smaller interior but the same exterior as FIG. 4 to exemplify the varying interior feature. Support base 54' corresponds to and aligns with base 12 and side wall supports 52' correspond to and align with each of side walls 4. Side wall supports 52' are thicker than side wall supports 52, and therefore can vary the interior volume of carton 100. Similar to the embodiment of FIG. 4, support base 54' is secured in position in carton 100 by the cooperation of support tabs 24 and tab cut-outs 56' in support base 54'.

From the foregoing it will be apparent that in the assembled condition of the two components, namely carton 100 with interior support insert 50, that sidewall supports 52 are substantially coextensive with their companions sidewall 4 of exterior carton 100 and interfit therewith in substantial planar engagement so as to reinforce sidewalls 4 against exterior forces while providing for easy removal by disengagement of support tabs 24 from their companion tab cut-outs 56.

It will thus be seen that the objects set forth above, among those made apparent from the preceding description, are efficiently attained and, since certain changes may be made in the above constructions without departing from the spirit and scope of the invention, it is intended that all matter contained in the above description o shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to all therebetween.

What is claimed is:

1. A carton assembly comprising:

a carton having a base, a pair of sidewalls extending from said base in laterally spaced relation, and a closure panel opposite said base;

a support component removably positioned in said carton, said support component having a support base for forming a confronting relationship with said base of said carton, a pair of laterally spaced sidewalls extending from said support base in a laterally spaced relation and substantially coextensive with said sidewalls of said carton and in planar confronting relation therewith for interfit therewith; and a releasable coupling means for securing said component in position in said carton to thereby reinforce said sidewalls of said carton, said releasable coupling means includes tabs positioned on said sidewalls of said carton at the ends toward said base and receiving slots positioned on said support base of said support component for receiving said tabs to form an interlocking structure between said base of said carton and said support component.

2. The carton assembly of claim 1 wherein said support component has a generally U-shaped configuration.

3. A carton assembly comprising:

a carton having a base, a pair of sidewalls extending from said base in laterally spaced relation, and a closure panel opposite said base;

a support component removably positioned in said carton, said support component having a pair of laterally spaced sidewalls substantially coextensive with said sidewalls of said carton and in planar confronting relation therewith for interfit therewith and a support base integrally extending from said sidewalls of said support component; and releasable coupling means including tabs disposed on the ends of said sidewalls of said carton towards said base and receiving slots for receiving said tabs and for securing said support component in position in said carton to reinforce said sidewalls of said carton and to form an interlocking structure on said base of said carton and said support component.

4. A carton assembly comprising:

a carton having a series of integrally connected panels including a base panel, a pair of laterally spaced sidewalls, and a top closure panel opposite said base panel, and a support component of generally U-shaped configuration interfitted in said carton for reinforcement thereof, said U-shaped configuration including a base panel in confronting relation with said carton base panel and substantially coextensive therewith and integrally connected side panels in confronting relation with said carton sidewalls and substantially coextensive therewith, and releasable coupling means for securing said support component in said carton as aforesaid; comprising an interlocking assembly having tabs disposed on the ends of said side walls towards said carton base panel and receiving slots on said component base panel for receiving said tabs, said tabs and said receiving slots integrally formed with the panels thereof.

5. A pair of unitary blanks for forming a container wherein the latter is provided with side and end walls delimiting a bottom and a u-shaped support member positioned in the interior of the container for supporting said walls, the first of said blanks comprising a pair of side wall panels and a pair of end wall panels, each having lower edges alternately arranged in side-by-side relation and foldably connected thereto, bottom tabs connected to the lower edges of said side wall panels, the second of said blanks comprising a pair of support walls and a bottom panel, said bottom panel interposed between said support walls and foldably connected thereto, said bottom panel having open end slots, the slots of said second panels being adapted to interlock with said tabs of said first blank when said blanks are set up to form said container.

6. The pair of blanks of claim 5, wherein the upper edge of one of the two end walls of the first blank has a closure flap foldably connected thereto, and the other of the two end walls on the first blank at the lower edge thereof has a closure flap foldably connected thereto.

7. The pair of blanks of claim 5, wherein the support walls of the second blank are dimensioned the same as or less than the dimensions of the side walls of the first blank.

* * * * *

UNITED STATES PATENT AND TRADEMARK OFFICE

CERTIFICATE OF CORRECTION

PATENT NO. : 5,279,457

DATED : January 18, 1994

INVENTOR(S) : Shinichi Masunaga

It is certified that error appears in the above-indentified patent and that said Letters Patent is hereby corrected as shown below:

On the title page: Item [73] Assignee: "Seiko" please delete --Epson --.

Signed and Sealed this

Tenth Day of January, 1995

*Attest:*

*Attesting Officer*

BRUCE LEHMAN

*Commissioner of Patents and Trademarks*